US007976331B1

(12) United States Patent
Yang

(10) Patent No.: US 7,976,331 B1
(45) Date of Patent: Jul. 12, 2011

(54) ELECTRIC POWER CONNECTOR AND POWER CABLE RETAINER ARRANGEMENT

(75) Inventor: Po-Cheng Yang, Taoyuan Hsien (TW)

(73) Assignee: Exito Electronics Co., Ltd., Taoyuan Hsien (TW)

( * ) Notice: Subject to any disclaimer, the term of this patent is extended or adjusted under 35 U.S.C. 154(b) by 0 days.

(21) Appl. No.: 12/692,643

(22) Filed: Jan. 24, 2010

(51) Int. Cl.
*H01R 13/62* (2006.01)

(52) U.S. Cl. ..... 439/369; 439/371; 439/373

(58) Field of Classification Search ..... 439/345, 439/371, 368, 369, 373
See application file for complete search history.

(56) References Cited

U.S. PATENT DOCUMENTS

| | | | | |
|---|---|---|---|---|
| 1,989,823 | A * | 2/1935 | Raabe | 439/370 |
| 4,773,874 | A * | 9/1988 | Kopeski, Jr. | 439/369 |
| 5,423,693 | A * | 6/1995 | Light | 439/369 |
| 7,207,826 | B1 * | 4/2007 | Yang | 439/373 |

* cited by examiner

*Primary Examiner* — Javaid Nasri

(57) ABSTRACT

An electric power connector and power cable retainer arrangement includes an electric power connector for the connection of the electric plug or socket of an external power cable for power transmission, and a power cable retainer that has a holder base provided at the electric power connector and a clip extended from the holder base for securing the cable of the external power cable in place to prohibit disconnection of the electric plug or socket of the external power cable.

1 Claim, 10 Drawing Sheets

ELECTRIC POWER CONNECTOR AND POWER CABLE RETAINER ARRANGEMENT

BACKGROUND OF THE INVENTION

1. Field of the Invention

The present invention relates to electric power connectors and more particularly, to an electric power connector and power cable retainer arrangement, which prohibits disconnection of the connected electric plug or electric socket.

2. Description of the Related Art

When using an electric appliance, the electric plug of the power cable of the electric appliance must be connected to an electric socket to obtain the necessary working power supply. However, when the user moves the electric appliance or the power cable of the electric appliance is stretched accidentally, the electric plug of the power cable of the electric appliance may be disconnected from the electric socket, causing power supply interruption or resulting in an accident.

SUMMARY OF THE INVENTION

The present invention has been accomplished under the circumstances in view. It is the main object of the present invention to provide an electric power connector and power cable retainer arrangement, which prohibits disconnection of the electric plug or socket of the external power cable accidentally, assuring a high level of safety.

To achieve this and other objects of the present invention, a electric power connector and power cable retainer arrangement comprises an electric power connector for the connection of the electric connector of an external power cable for power transmission, and at least one power cable retainer provided at the electric power connector for securing the cable of the external power cable been connected to the electric power connector to prohibit disconnection of the electric connector of the external power cable from the electric connector. Each power cable retainer comprises a holder base affixed to the electric power connector and a clip extended from the holder base for securing the cable of the connected external power cable. The clip defines a retaining hole and an opening through which the cable of the attached external power cable is set into the retaining hole.

DETAILED DESCRIPTION OF THE PREFERRED EMBODIMENT

Figure 1:
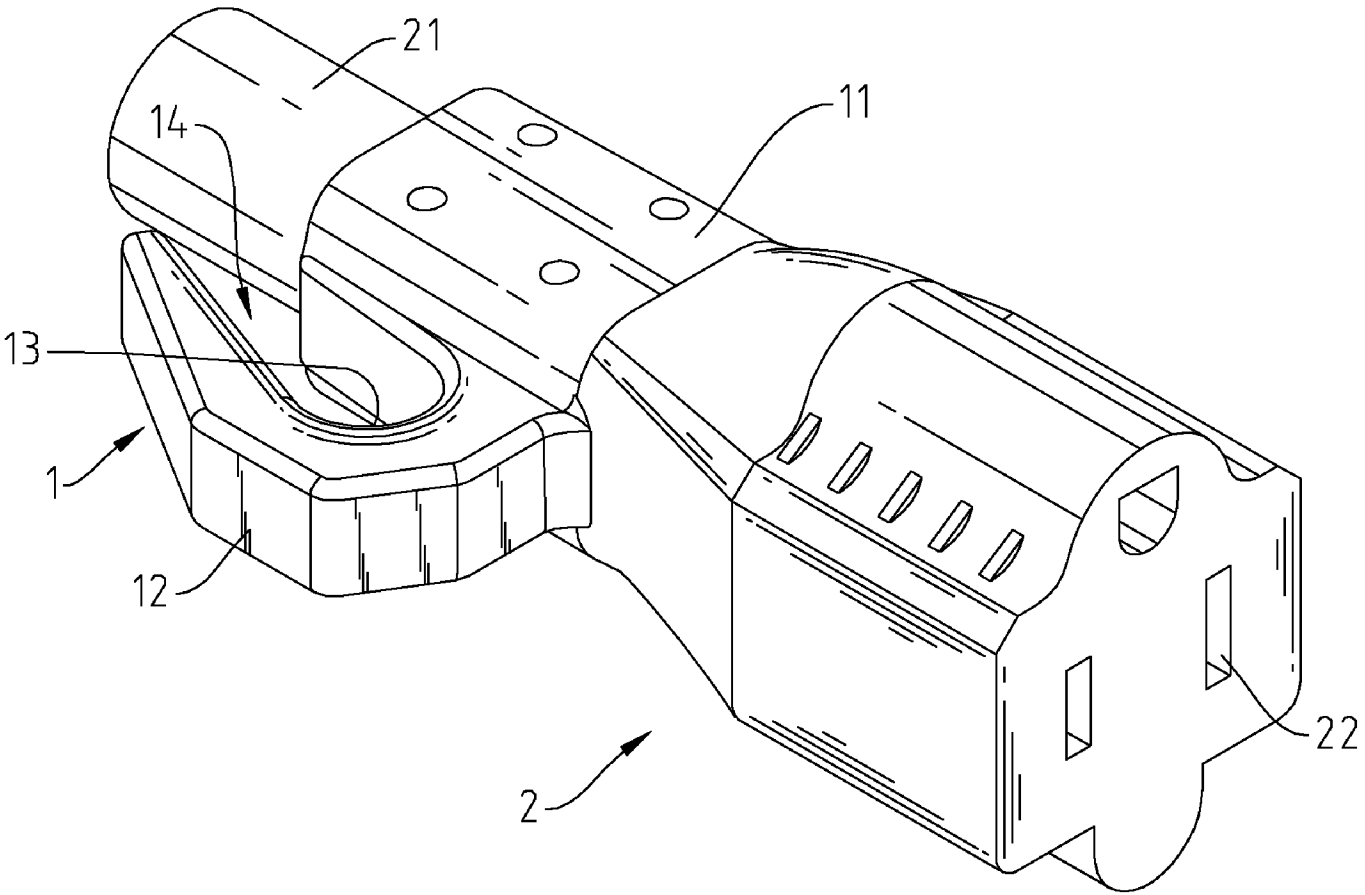
FIG. 1 is an oblique elevation of an electric power connector in accordance with a first embodiment of the present invention.

Referring to FIG. 1, an electric power connector and power cable retainer arrangement in accordance with a first embodiment of the present invention is shown comprising an electric power connector 2 and a power cable retainer 1 provided at the electric power connector 2.

The power cable retainer 1 has a holder base 11 formed integral with a part (for example, the rear part of the electrically insulative housing) of the electric power connector 2 and a clip 12 extended from the holder base 11. The clip 12 and the holder base 11 define a retaining hole 13 and an opening 14. The opening 14 is defined between the free end of the clip 12 and the holder base 11.

The electric power connector 2 according to this embodiment is an electric socket, having an extension cable 21 extending out of the rear side thereof and insertion holes 22 located on the front side thereof. The holder base 11 is formed integral with a part of the electric power connector 2 adjacent to the extension cable 21.

Figure 2:
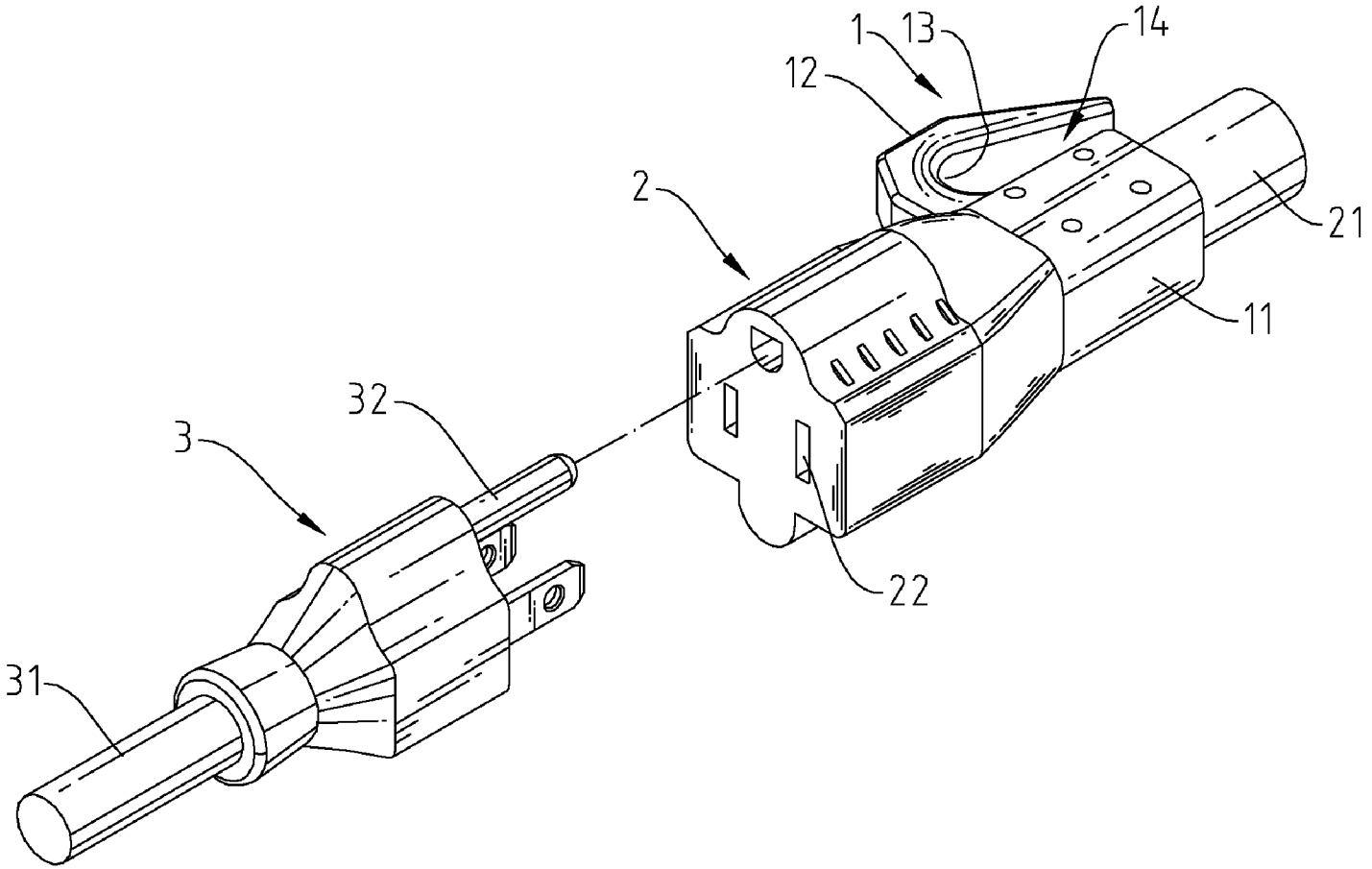
FIG. 2 illustrates a status of use of the electric power connector in accordance with the first embodiment of the present invention before connection of an external electric plug.
Figure 3:
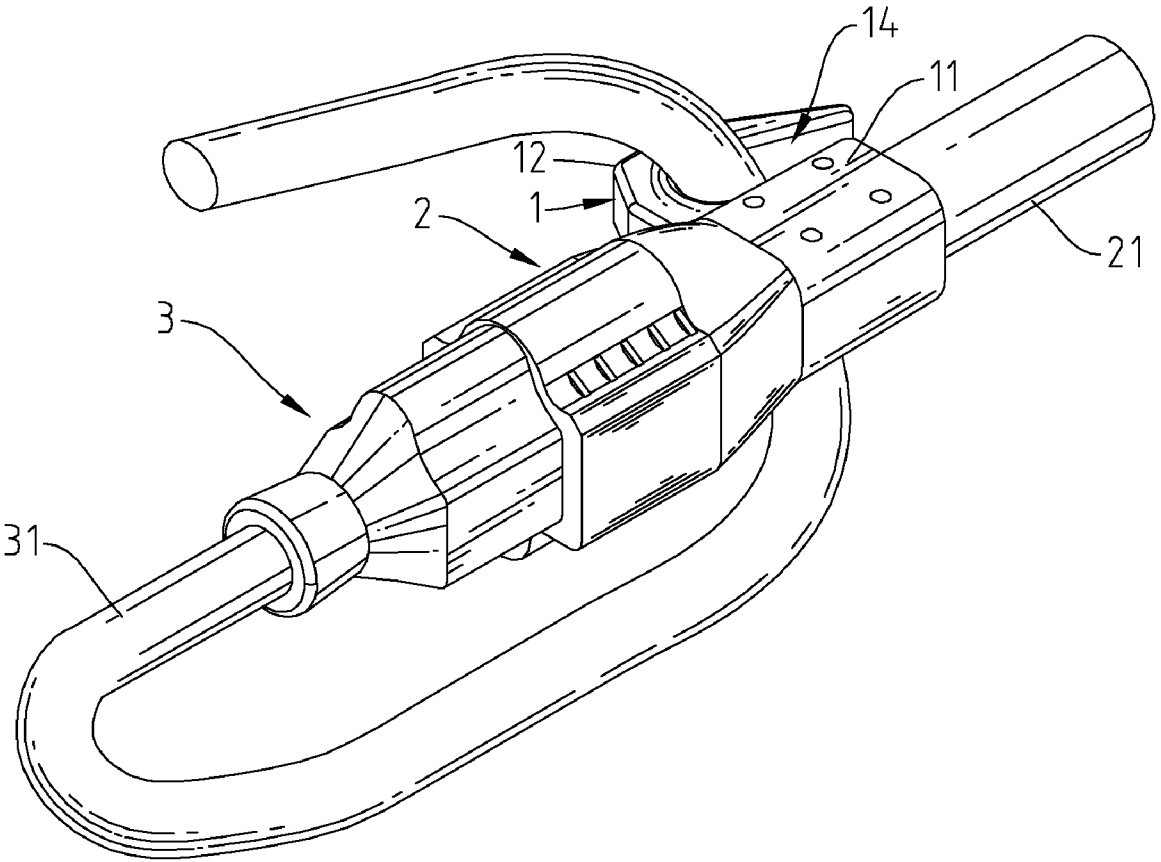
FIG. 3 corresponds to FIG. 2, showing the electric plug connected to the electric power connector.

Referring to FIGS. 2 and 3, when connecting an electric plug 3 to the electric power connector (electric socket) 2, insert the metal contact blades 32 of the electric plug 3 into the insertion holes 22 of the electric power connector (electric socket) 2 to keep the electric power connector (electric socket) 2 and the electric plug 3 in an electrically connected condition, then turn the power cable 31 of the electric plug 3 toward the electric power connector (electric socket) 2 and force the power cable 31 through the opening 14 into the retaining hole 13. When forcing the power cable 31 of the electric plug 3 into the opening 14, the clip 12 will be temporarily deformed for allowing the power cable 31 of the electric plug 3 to be moved into the retaining hole 13. Immediately after the power cable 31 entered the retaining hole 13, the clip 12 returns to its former shape subject to its elastic material property, thereby holding down the power cable 31. Thus, if the user, either intendedly or accidentally, moves the electric or electronic apparatus (not shown) to which the power cable 31 of the electric plug 3 is connected, the friction resistance produced between the power cable 31 of the electric plug 3 and the clip 12 prohibits disconnection of the electric plug 3 from the electric power connector (electric socket) 2.

Figure 4:
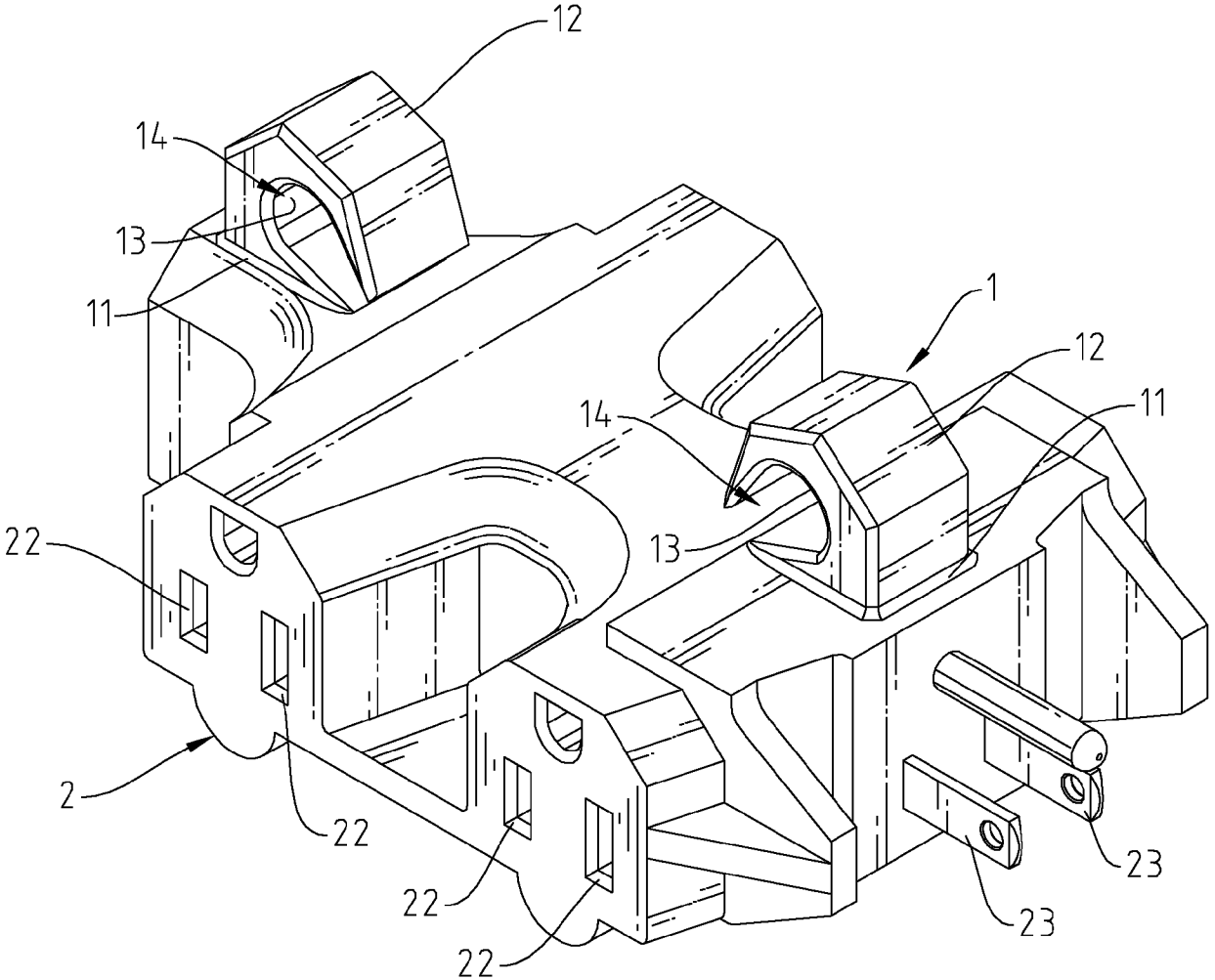
FIG. 4 is an oblique elevation of an electric power connector in accordance with a second embodiment of the present invention.
Figure 5:
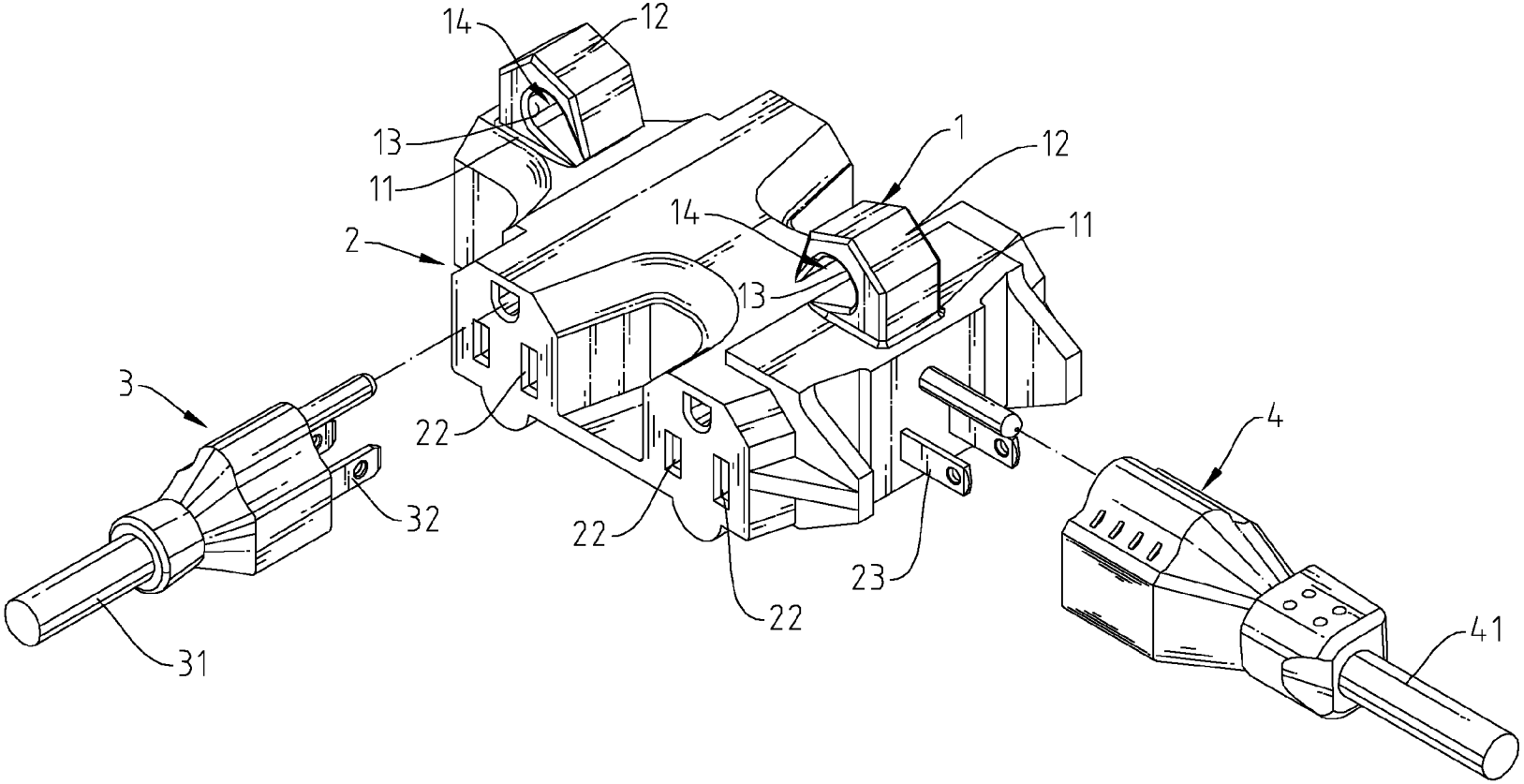
FIG. 5 illustrates a status of use of the electric power connector in accordance with the second embodiment of the present invention before connection of an external electric plug and an external socket type power extension cable.
Figure 6:
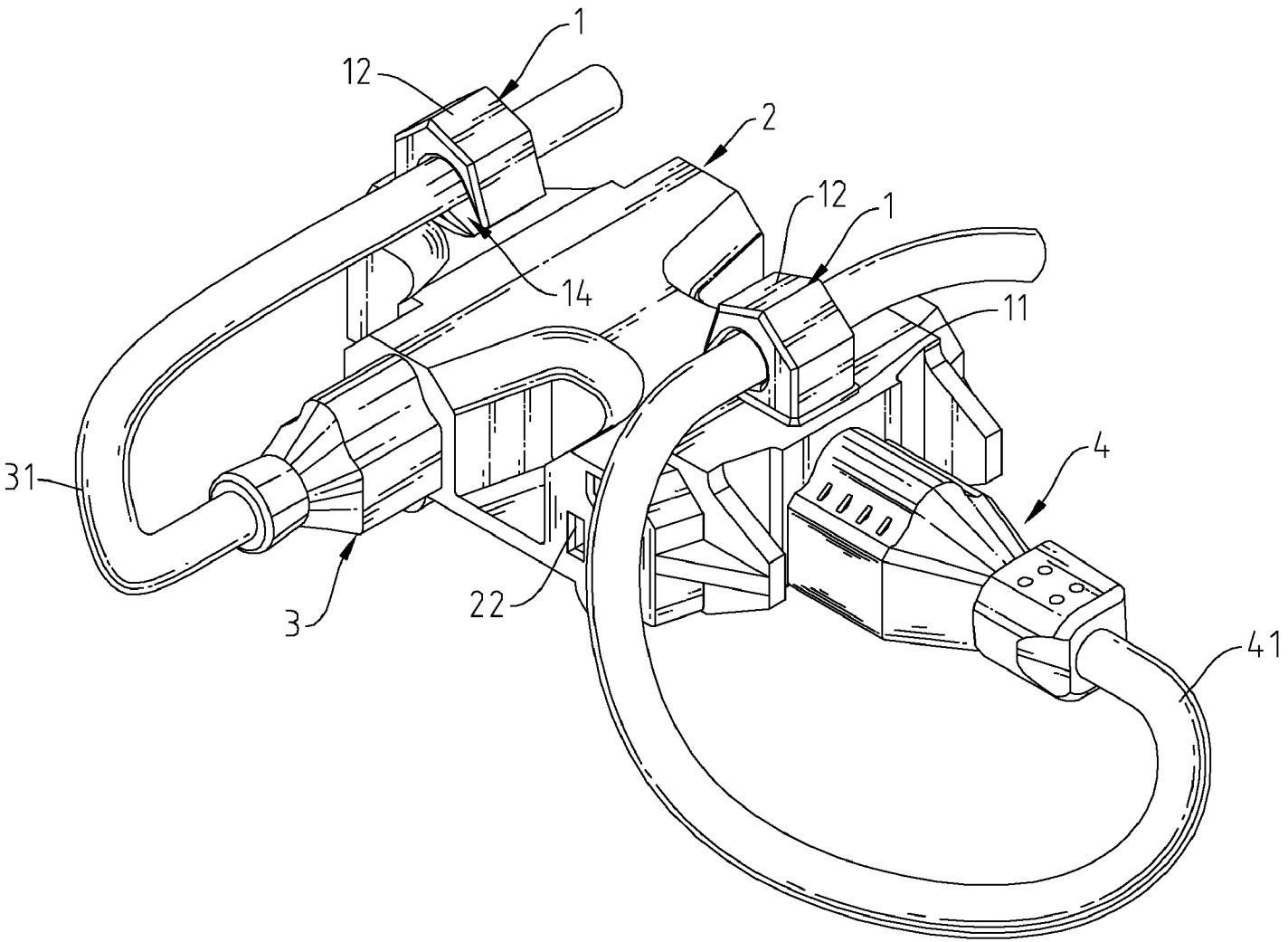
FIG. 6 corresponds to FIG. 5, showing the external electric plug and the external socket type power extension cable connected to the electric power connector.
Figure 7:
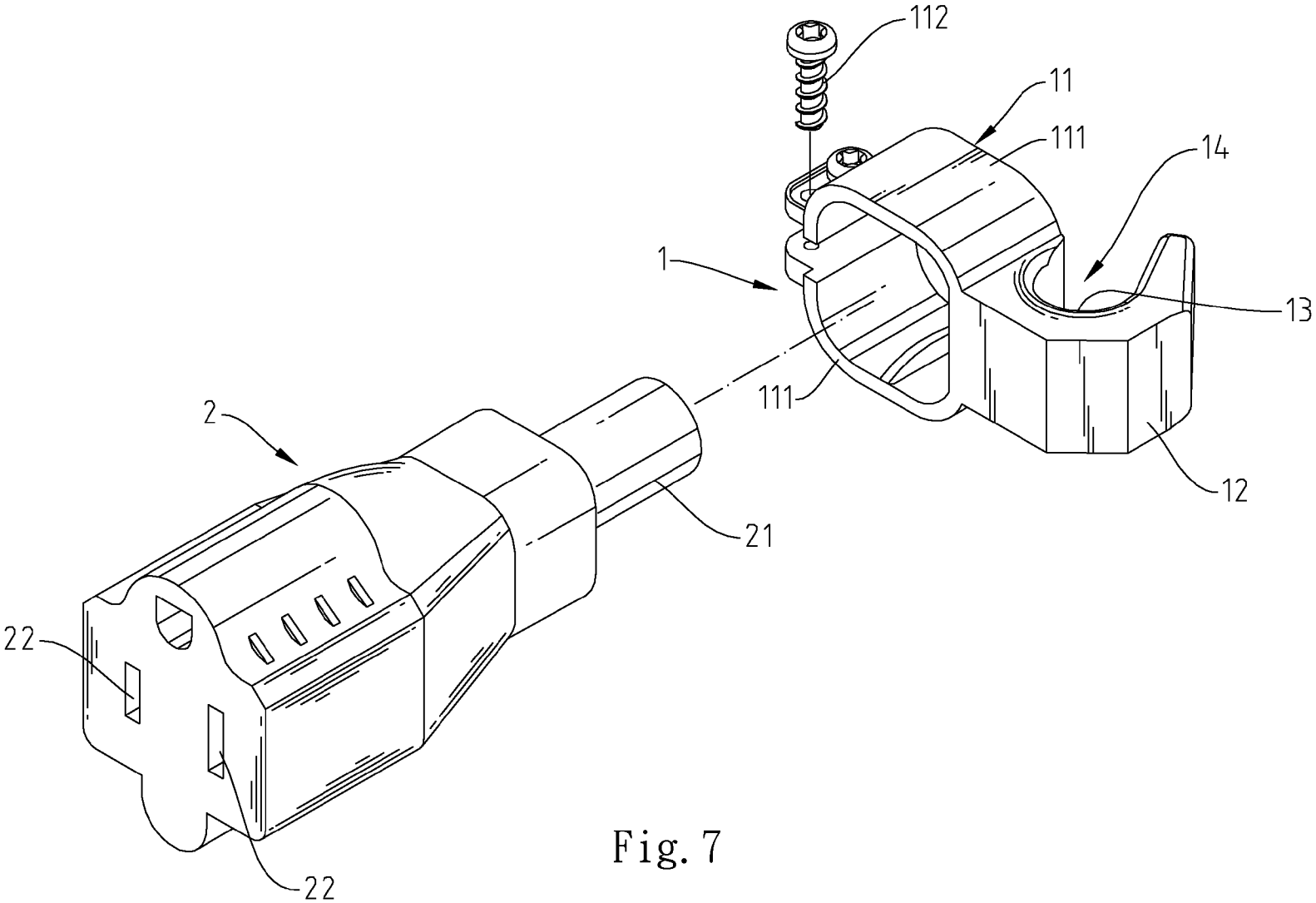
FIG. 7 is an exploded view of an electric power connector in accordance with a third embodiment of the present invention.
Figure 8:
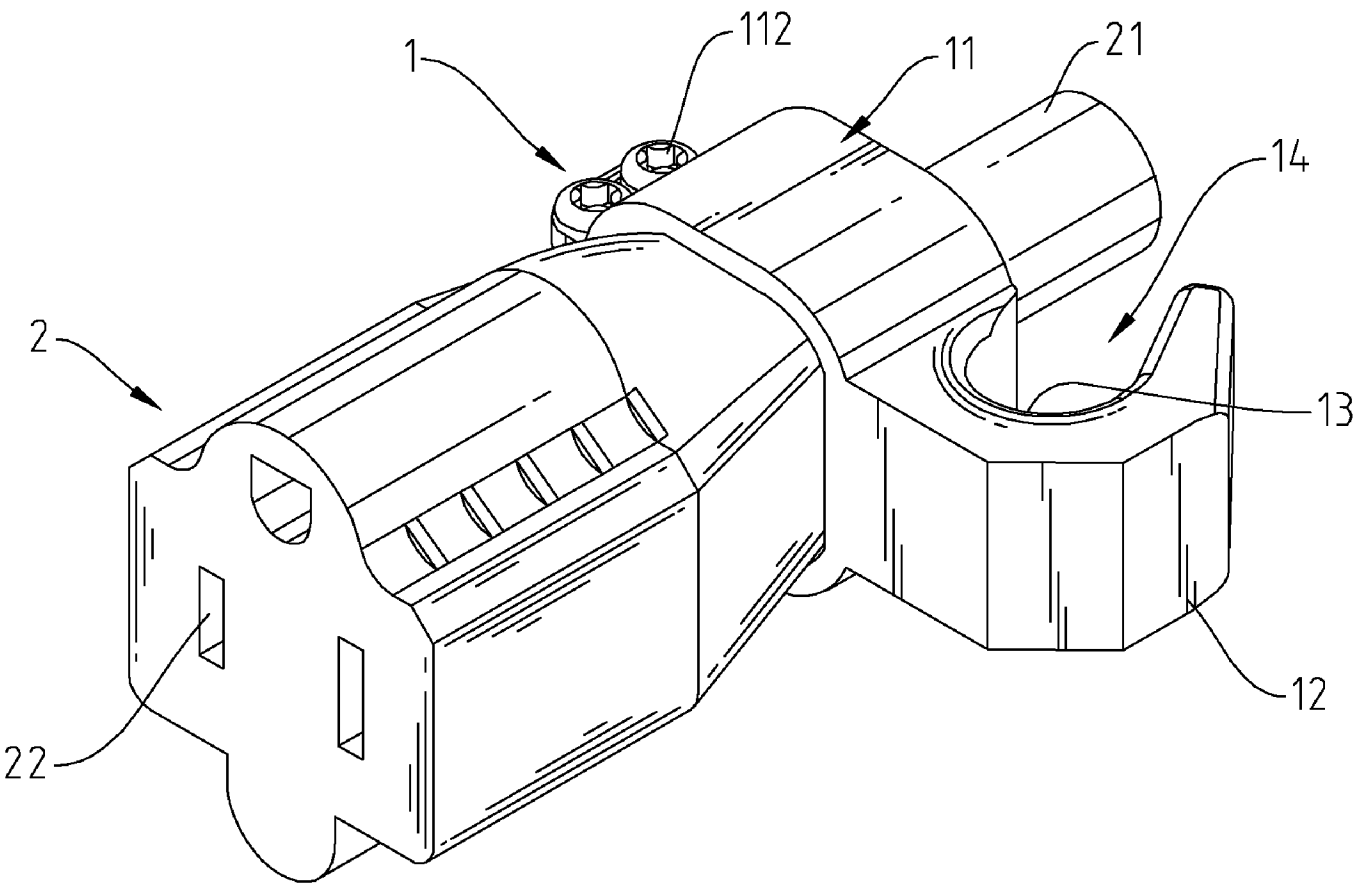
FIG. 8 is an elevational assembly view of the electric power connector in accordance with the third embodiment of the present invention.
Figure 9:
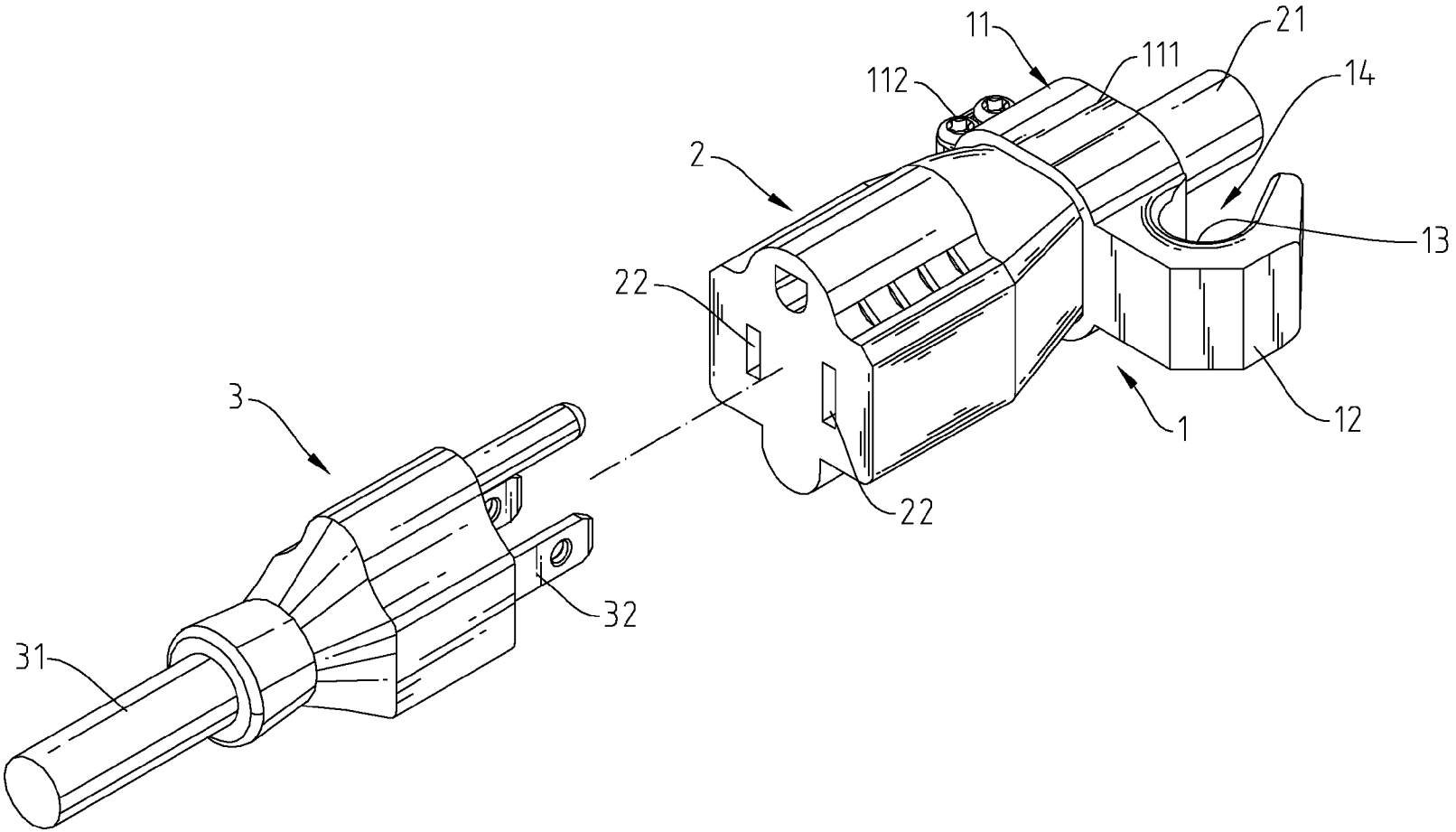
FIG. 9 illustrates a status of use of the electric power connector in accordance with the third embodiment of the present invention before connection of an external electric plug.
Figure 10:
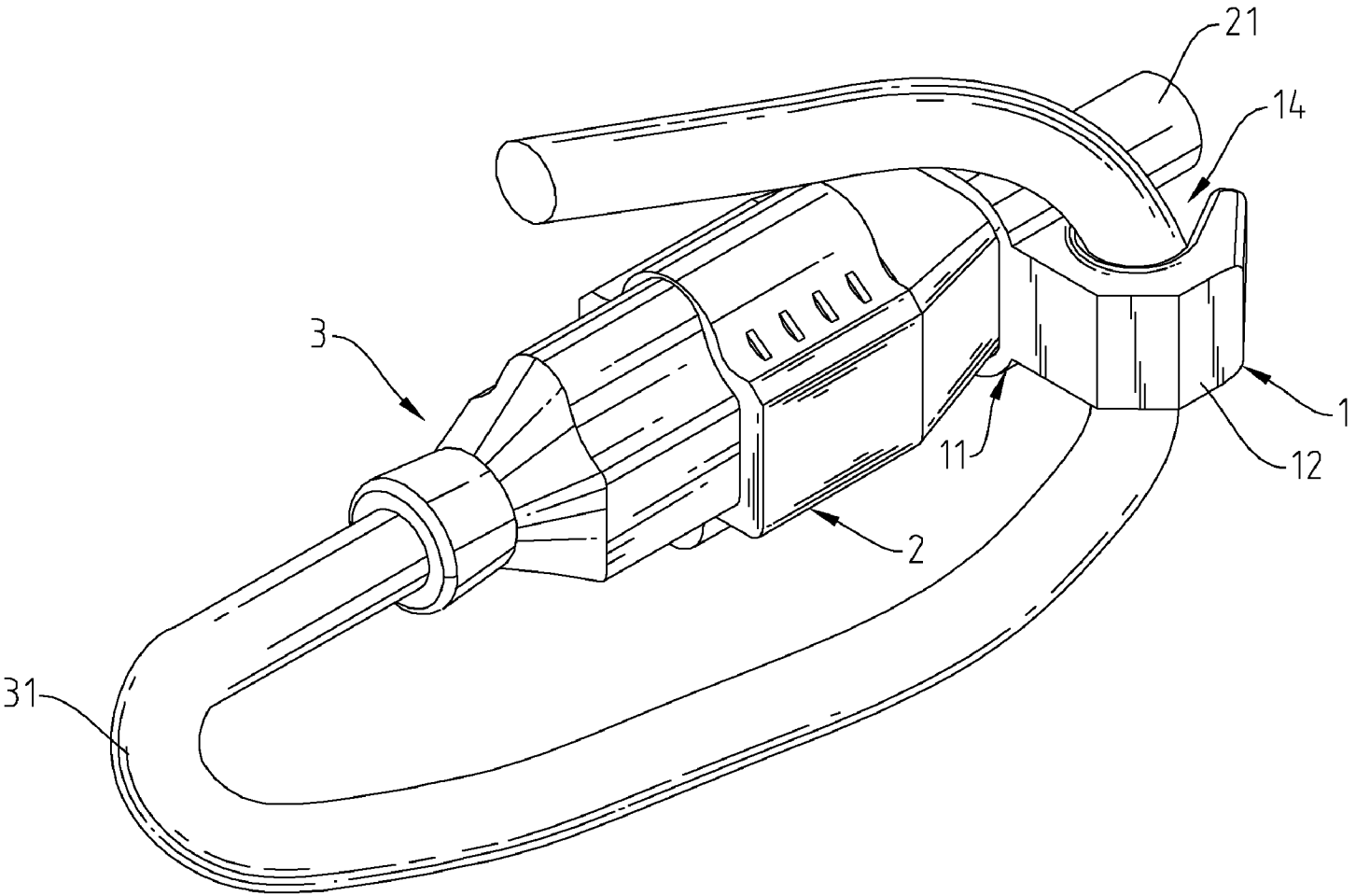
FIG. 10 corresponds to FIG. 9, showing the electric plug connected to the electric power connector.

FIGS. 4~6 illustrate an electric power connector and power cable retainer arrangement in accordance with a second embodiment of the present invention. According to this second embodiment, the electric power connector comprises an electric power connector 2 and a plurality of power cable retainers 1 provided at the electric power connector 2. The electric power connector 2 according to this second embodiment is a multi-outlet socket having multiple sets of insertion holes 22 for power input and a set of metal contact blades 23 for power output. Each power cable retainer 1 has a holder base 11 formed integral with a part (of the electrically insulative housing) of the electric power connector 2 and a clip 12 extended from the holder base 11. The clip 12 and the holder base 11 define a retaining hole 13 and an opening 14. The opening 14 is defined between the free end of the clip 12 and the holder base 11. When a socket type power extension cable 4 is connected to the metal contact blades 23, the power cable 41 of the socket type power extension cable 4 is forced through the opening 14 of the clip 12 of one of the power cable retainers 1 into the retaining hole 13 of the respective clip 12. When the metal contact blades 32 of an electric plug 3 are into one set of insertion holes 22 of the electric power connector 2, the power cable 31 of the electric plug 3 is forced through the opening 14 of the clip 12 of another power cable retainer 1 into the retaining hole 13 of the respective clip 12. Thus, the electric plug 3 and the socket type power extension cable 4 will not be disconnected from the electric power connector 2 accidentally.

FIGS. 7~10 illustrate an electric power connector and power cable retainer arrangement in accordance with a third embodiment of the present invention. According to this third embodiment, the electric power connector comprises an electric power connector 2 and a power cable retainer 1.

The power cable retainer 1 comprises a holder base 11 having two clamping arms 111, a clip 12 connected between the two clamping arms 111 of the holder base 11. The clip 12 and the holder base 11 define a retaining hole 13 and an opening 14. The opening 14 is defined between the free end of the clip 12 and the holder base 11. During application, the two clamping arms 111 of the holder base 11 of the power cable retainer 1 are clamped on a part (for example, the rear part of the electrically insulative housing) of the electric power connector 2 and then the free ends of the two clamping arms 111 are fixedly fastened together with screws 112. Thus, the power cable retainer 1 is firmly secured to the electric power connector 2. When connecting an electric plug 3 to the electric power connector 2, insert the metal contact blades 32 of the electric plug 3 into the insertion holes 22 of the electric power connector 2, and then turn the power cable 31 of the electric plug 3 toward the electric power connector 2 and force the power cable 31 through the opening 14 into the retaining hole 13. Thus, the power cable 31 of the electric plug 3 is positively secured to the power cable retainer 1, and the electric plug 3 will not be disconnected from the electric power connector 2 accidentally.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electric power connector and power cable retainer arrangement, comprising:

a first electric power connector for connecting to a second electric power connector; and at least one power cable retainer provided on said first electric power connector for securing a cable of the second electric power connector, the at least one power cable retainer comprising a holder base detachably mounted on said first electric power connector, said holder base comprising two clamping arms removably clamped onto said first electric power connector, and an elastic clip extending from said holder base for securing the cable of the second electric power connector, said clip defining a retaining hole sized to accept the cable of the second electric power connector and an opening sized smaller than the cable of the second electric power connector and through which the cable of the second electric power connector can be passed by elastically deforming the clip to set the cable of the second electric power connector into said retaining hole;

wherein said two clamping arms of said holder base are affixed together with screws to secure said holder base to said electric power connector firmly in place.

* * * * *